United States Patent [19]

Küng

[11] Patent Number: 4,584,221

[45] Date of Patent: Apr. 22, 1986

[54] FLOOR COVERING ASSEMBLY

[75] Inventor: Peter Küng, Rapperswil, Switzerland

[73] Assignee: Sportforderung Peter Kung AG, Rapperswil, Switzerland

[21] Appl. No.: 632,480

[22] Filed: Jul. 19, 1984

[51] Int. Cl.[4] ..... B32B 3/06; B32B 3/24; E01C 5/20

[52] U.S. Cl. ..... 428/44; 428/131; 52/177; 52/589; 52/593; 404/36; 404/40; 404/41

[58] Field of Search ..... 428/44, 52; 52/177, 52/589, 593; 404/41, 40, 36

[56] References Cited

U.S. PATENT DOCUMENTS 2,372,520 3/1945 Rubin ..... 428/52 X
3,960,375 6/1976 Bibi-Roubi et al. ..... 404/41

*Primary Examiner*—Alexander S. Thomas
*Attorney, Agent, or Firm*—Burgess, Ryan & Wayne

[57] ABSTRACT

By means of the coupling members and corresponding supporting feet of adjacent elements a coupling between an arbitrary number of elements of the floor covering assembly is possible. In order to prevent the separation of the engaged respective pairs supporting feet-coupling members in a positive manner locking cams having upwards facing abutment surfaces lock behind side sections of respective adjacent elements.

2 Claims, 7 Drawing Figures

Fig. 3a
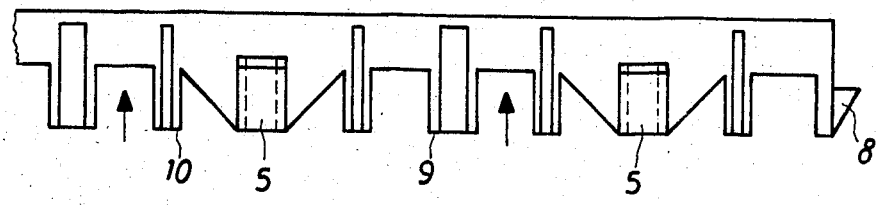
Fig. 3b
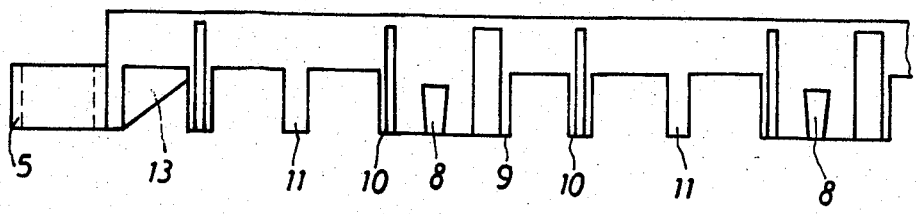
Fig. 4a
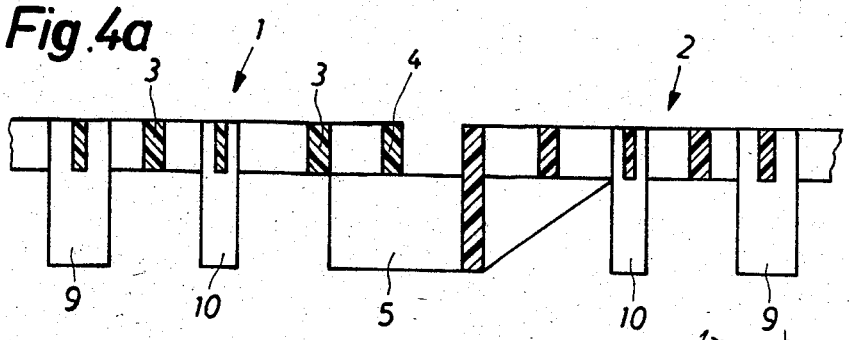
Fig. 4b
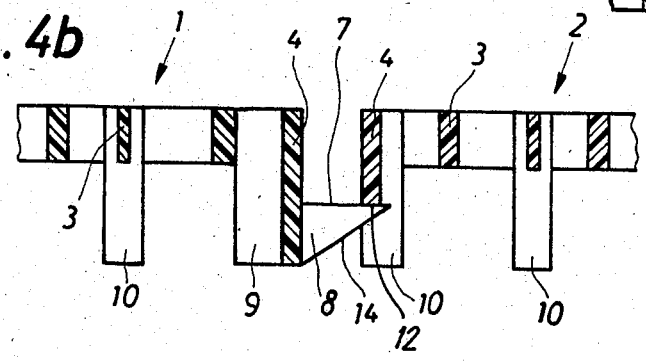
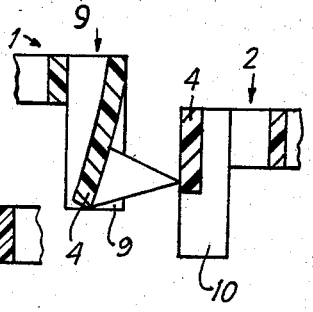
Fig. 4c

FLOOR COVERING ASSEMBLY

BACKGROUND OF THE INVENTION

1. Field Of The Invention

The present invention relates to a floor covering assembly having a plurality of plate-like plastic elements made of an elastic material, which plastic elements are interconnected with a clearance, each element having supporting feet located at its bottom surface and coupling members located on at least one side surface, which coupling members are provided with an oblong hole each receiving supporting feet of an adjacent element in a manner displaceable in one direction.

Such plastic elements are commonly used as coverings for athletic fields and designs thereof having an upper surface provided with a lattice or grid-like structure have specifically been applied in floor coverings of tennis courts. The advantage of the plastic elements is that they are suitable for an outdoor use.

Elastic materials which are commonly used to produce such floor covering assemblys are, however, subject to thermal expansion. Accordingly it is necessary to provide a clearance between adjacent elements allowing a free expansion thereof. The clearance avoids a distortion or warping respectively of individual elements of the floor covering.

Great care must be taken to avoid a disconnection of the plug-like connection between the coupling members and the corresponding supporting feet at maximal elongation and highest loading thereof.

2. Description Of The Prior Art

In order to solve above problems known designs of plug-like connections encompass conically extending supporting feet and correspondingly designed coupling elements. These supporting feet are urged with their thicker leading end through the reduced side of the opening in the coupling element and in their end position the supporting feet snap into the corresponding coupling element.

In utilizing such a coupling of the elements it has been found that a reliable easy displacing of the supporting feet within the coupling members warranting an adjustable clearance between the elements is not always achieved.

The reason for this difficulty is that if the supporting feet have a considerable clearance within the coupling members allowing an easy displacing of the feet within the coupling members the feet may be pressed out from the coupling members by exerting comparatively small forces. On the other hand if the clearance is reduced correspondingly it may be possible that the supporting feet jam in the grooves of their coupling members.

SUMMARY OF THE INVENTION

Hence, it is a general object of the present invention to provide an improved floor covering assembly having supporting feet and coupling members provided with a sufficient clearance allowing a relative lateral movement thereof and yet remaining safely interlocked at all instances.

A further object of the invention is to provide a floor covering assembly having a plurality of plate-like plastic elements in which each element comprises laterally projecting locking cams located on frame sides thereof without any coupling elements, which locking cams cooperate with a frame bottom surface of a respective adjacent element and have an upwards projecting abutment surface.

When mounting the floor covering assembly by plugging respective supporting feet in respective coupling members the sides of the elements located oppositely to the projecting locking cams with slip beyond the cams due to an elastic deformation When the elements are in their final position, the locking cams lock behind sections of the outer sides of the corresponding elements and prevent a separation of the elements.

According to a preferred embodiment the supporting feet are arranged at the lower sides of the elements and in rows extending parallel to the sides of the elements. The coupling members of such embodiment are arranged in a respective of such rows and the locking cams are located between respective of such rows.

BRIEF DESCRIPTION OF THE DRAWINGS

The present invention will be more fully understood and objects other then those set forth above will become apparent when consideration is given to the following detailed description thereof. Such description makes reference to the annexed drawings wherein:

FIG. 3*a* a side view in the direction of arrow A of the element illustrated in FIG. 1;

FIG. 3*b* a side view in the direction of the arrow B of the element illustrated in FIG. 1;

FIG. 4*a* schematically a section through two interconnected elements at the location of the coupling member of the first element;

FIG. 4*b* schematic a section through two coupling elements at the location of a locking cam of the second element;

FIG. 4*c* is a schematic cross-sectional view through two coupling elements at the location of a locking cam of the second element, with one element being forced to move in the direction of the arrows shown therein.

DETAILED DESCRIPTION OF THE PREFERRED EMBODIMENT

Figure 1:
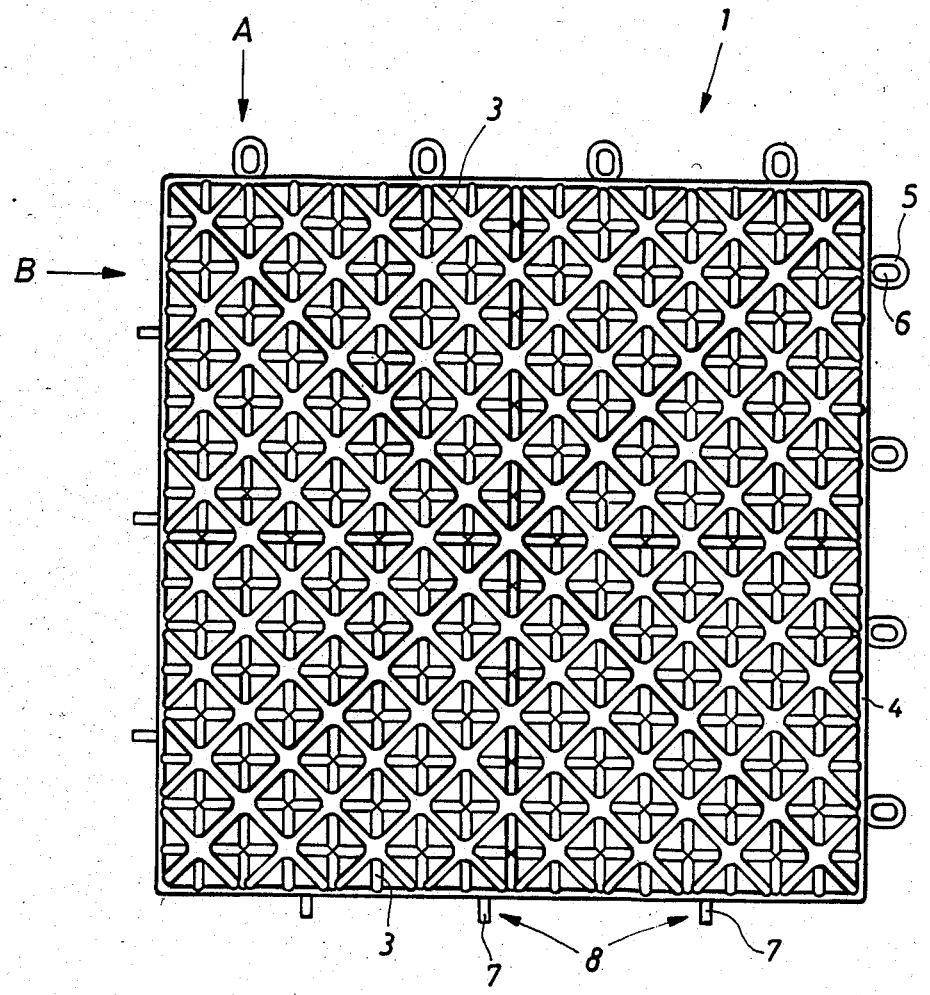
FIG. 1 is a schematic plan view of a plate-shaped element of a floor covering assembly.

FIG. 1 illustrates a plan view of a preferred embodiment showing a plate-like element 1. This element has a grid-like structure comprising struts 3 and its outer frame 4. The coupling members 5 comprise oblong holds 6 also illustrated are the abutment surfaces 7 of the locking cams 8 which abutment surfaces 7 face upwards.

Figure 2:
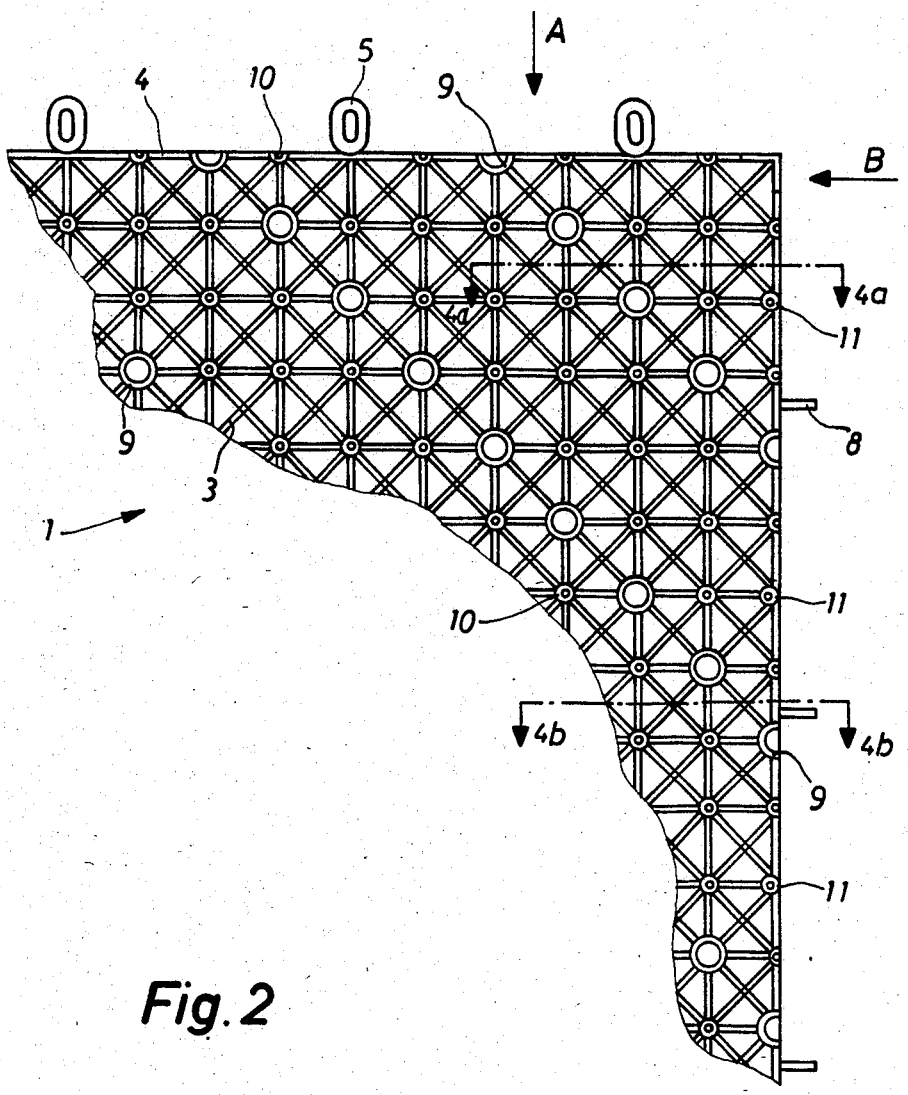
FIG. 2 a view from below of the element illustrated in FIG. 1.

FIG. 2 illustrates a view of the element of FIG. 1 from below and illustrating specifically the outer frame 4, the coupling 5 and the locking cams 8. Adjacent the supporting feet 9 and 10 having different diameters supporting feet 11 are shown which are intended to cooperate with coupling members of an adjacent element.

FIGS. 3*a* and 3*b* illustrate side views in the direction of the arrows A and B of the element shown in FIG. 1. The reference numerals 12 define sections of the frame which will be engaged by locking cams of an adjacent element extending therearound. The coupling members 5 are supported additionally by reinforcing struts 3.

FIGS. 4*a* and 4*b* illustrate sections through two locked elements 1 and 2 designed in accordance with the invention. Both sections shown extend parallel to each other and their location and extent is illustrated in FIG. 2 with regard to element 1 by dash-dotted lines.

In FIG. 4*a* the section is located such that a side view of the coupling member of element 2 can be seen and in FIG. 4*b*; the locking cam 8 of element 1 can be seen in side view. The locking cam 8 of element 1 is provided with a rising ramping flank 14 and an abutment surface 7. When coupling the two elements 1 and 2 the side surface 4 of element 2 will glide along the rampling flank 14 and will push the locking cam somewhat away due to the elastic deformation of the side section 4 of element 1. As soon as the elements are in their final position the locking cam will snap back into its rest position. The elements are then locked together.

While there is shown and described a present preferred embodiment of the invention, it is to be distinctly understood that the invention is not limited thereto, but may be otherwise variously embodied and practiced within the scope of the appended claims.

I claim:

1. A floor covering assembly comprising:

a plurality of rectangular plate-like plastic elements made of an elastic material, said plastic elements being interconnected with a clearance between adjacent elements, each element having supporting feet located at a bottom surface of said element and arranged in rows extending parallel to the sides of said element, each element also having coupling members located on at least one side of said element, the coupling members on each said at least one side being arranged in a row extending parallel to said at least one side of said element, each of said coupling members having an oblong hole receiving supporting feet of an adjacent element in a manner such that said adjacent element is displaceable in a given direction, each element further having laterally projecting locking cams located on frame sides thereof without any coupling elements said locking cams being located between coupling members positioned on opposite sides of the respective element, each of said locking cams cooperating with a frame bottom surface of an adjacent element and having an upwardly projecting abutment surface.

2. The floor covering assembly of claim 1, in which two meeting sides of every element comprise at least two coupling members each and the other sides comprise at least two locking cams each.

* * * * *